United States Patent [19]

Kusaka et al.

[11] 4,035,748

[45] July 12, 1977

[54] COAXIAL IMPEDANCE TRANSDUCER PAD

[75] Inventors: Keijiro Kusaka, Machida; Yasushi Otomo, Miyagi, both of Japan

[73] Assignee: Bunker Ramo Corporation, Oak Brook, Ill.

[21] Appl. No.: 616,219

[22] Filed: Sept. 24, 1975

[30] Foreign Application Priority Data

Sept. 26, 1974 Japan .....49-109963

[51] Int. Cl.[2] ..... H01P 5/08

[52] U.S. Cl. ..... 333/33; 333/81 A

[58] Field of Search ..... 333/33, 81 R, 81 A

[56] References Cited

U.S. PATENT DOCUMENTS

| | | | |
|---|---|---|---|
| 3,227,975 | 1/1966 | Hewbett et al. | 333/81 A |
| 3,260,971 | 7/1966 | Bacher et al. | 333/81 A |

*Primary Examiner*—Paul L. Gensler
*Attorney, Agent, or Firm*—William Lohff; F. M. Arbuckle

[57] ABSTRACT

A coaxial impedance matching device employing film resistors in place of conventional rod and disc resistors. In a preferred embodiment, an elongated rectangular film resistor is deposited across the middle of a square insulation substrate with a pair of metal strips along opposite edges of the substrate and contacting the ends of the film resistor. Center metalized contacts are made to opposite sides of the film resistor, the lengths of contact with the sides being determined by the impedances of the cables to be connected thereto.

6 Claims, 7 Drawing Figures

COAXIAL IMPEDANCE TRANSDUCER PAD

BACKGROUND OF THE INVENTION

1. Field of the Invention

This invention relates to impedance matching devices, and in particular to impedance matching devices for coaxial cables.

2. Description of Prior Art

Conventional impedance matching devices use rod and disc shaped resistors arranged so that one end of a rod resistor is in electrical contact with the center of either side of the disc resistor. However, the fastening pressure required to maintain this connection tends to cause cracking or damage in the resistors. Therefore, the assembly of the device is critical and difficult and the device is subject to physical damage in the field. Also the frequencies for which the device can be used are limited by the stray capacitances and inductances inherent in the structure.

SUMMARY OF THE INVENTION

The present invention offers a coaxial impedance matching device utilizing a card attenuator with a deposited thin film resistor, thereby avoiding the various defects of conventional impedance matching devices noted above. By replacing the known construction of rod resistors and disc resistors with a newly conceived card attenuator with film resistor pattern, the following improvements are achieved; simplification of manufacturing impedance matching device electronic parts; consistency of electrical characteristics; reduction of damage to the impedance matching device electrical parts and reduction in the occurrence of cracks during the assembly process; minimization of stray capacitances and inductances; and simplification of assembly.

DETAILED DESCRIPTION OF THE PREFERRED EMBODIMENTS

Figure 1:
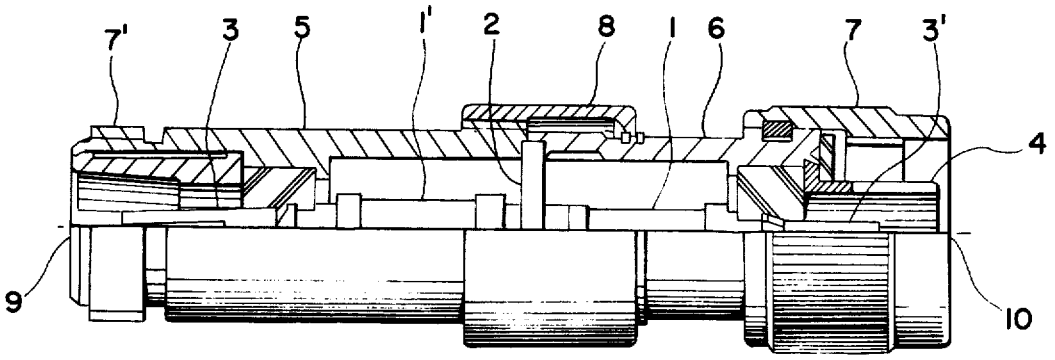
FIG. 1. PRIOR ART
FIG. 1 is a cutaway drawing of a conventional impedance matching device.

FIG. 1 shows the structure of a conventional impedance matching device. FIG. 1 shows rod resistors 1,1' with predetermined resistance values, a disc resistor 2, inner contact pins 3,3', an outer contact 4, a first body part 5, a second body part 6, connector members 7,7', a coupling 8, and connector openings 9 and 10 for attachment of coaxial cables thereto.

An impedance matching device in accordance with FIG. 1 can be formed by inserting the rod resistor 1 and the disc resistor 2 into the second body 6, and then matching the first body 5 which houses the rod resistor 1' with the end of the second body 6, coupling the bodies 5 and 6 with the coupling 8, thereby enabling the peripheral ends of the disc resistor 2 to be electrically connected with the body, and also enabling the ends of the rod resistors 1,1' to be connected with the inner contact pins 3,3' of connector members 7,7'. This arrangement is used by attaching a female connector (not shown in the figure) with an attached coaxial cable to the opening 9 by means of the connector member 7', and by attaching a male connector (not shown in the figure) with an attached coaxial cable to the opening 10 by means of the connector member 7.

Figure 5:
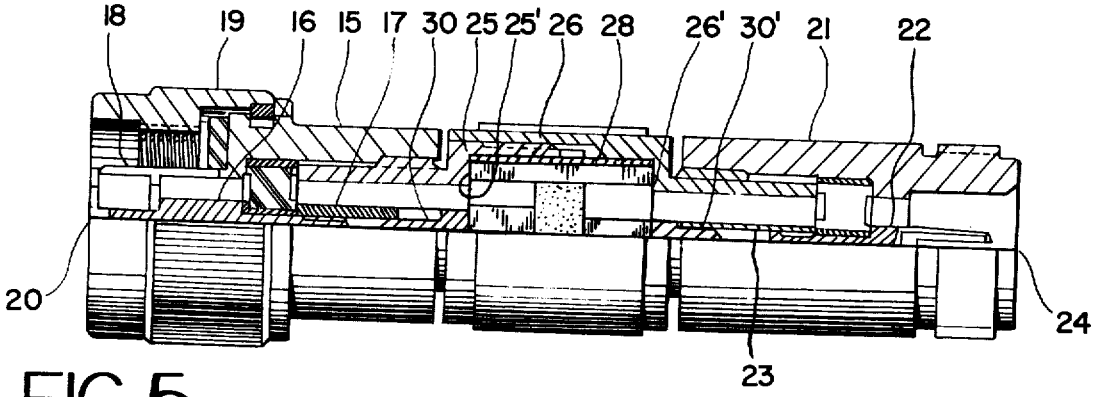
FIG. 5 is a partial, cross-sectional view of an example of the impedance matching device of the present invention mounted in a housing.

As used in this description, the phrase "impedance matching device" may refer to the film resistor card 27 or to the card 27 mounted in a connector housing as shown in FIG. 5. The artisan will appreciate that impedance matching is electronically accomplished by the film resistor card 27 alone and thus may be effectively used outside a connector housing.

Figure 2:
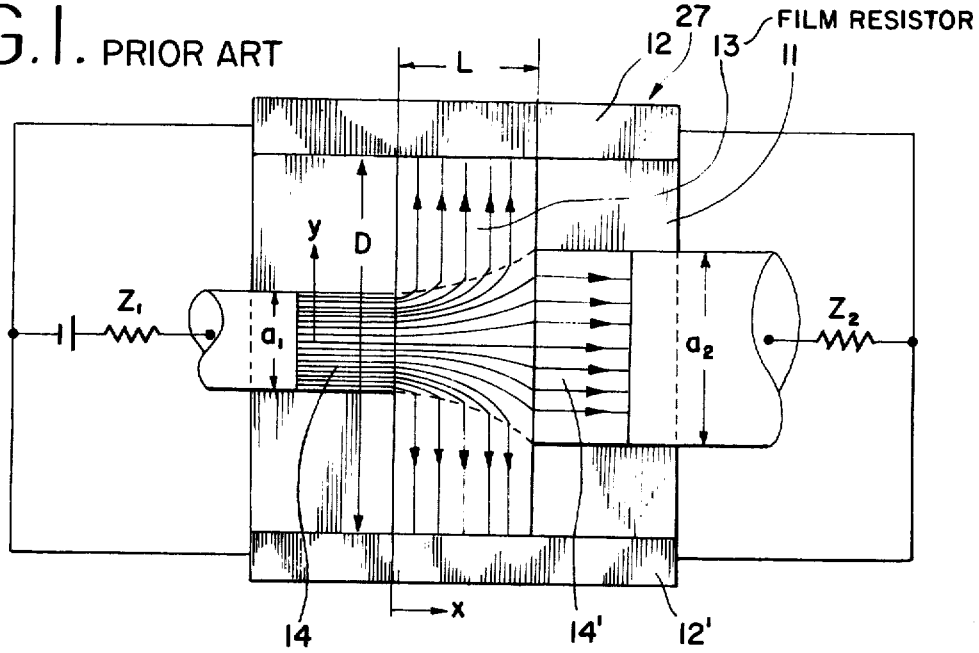
FIG. 2 shows the film resistor attenuator card of the present invention superimposed with a symbolic diagram of current flow and impedance distribution.
Figure 3:
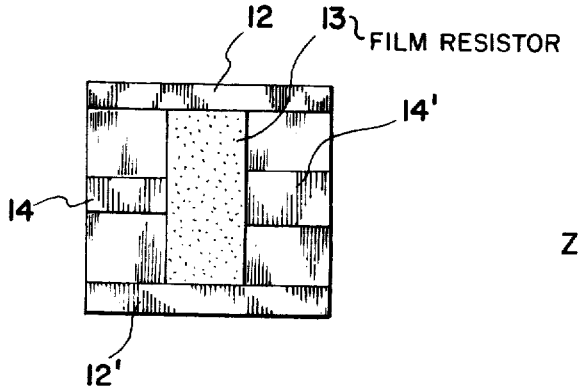
FIG. 3 is a plan view of the film resistor attenuator card.

As seen in FIGS. 2 and 3, the impedance matching device of the present invention comprises a film resistor card 27, having a rectangular film resistor 13 in the center of a square insulation substrate 11, the resistor 13 bridging conductive edge strips 12,12'. Central conductive paths are provided in the form of input and output conductive strips 14,14' disposed in the center of the insulation substrate 11 and extending between the edges of the substrate 11 and both sides of the film resistor 13. Conductive strips 12,12',14,14' are preferably of metal and may be formed using standard printed circuit board techniques.

When the width of the input conductive strip 14 is $a_1$ and that of output conductive strip 14' is $a_2$ (where $a_2 > a_1$), the distribution of the current from the input conductive strip 14 through the film resistor 13 to the conductive edge strips 12,12' and to the output conductive strip 14' is represented by the solid-line arrows of FIG. 2, and the impedance curve extending between the input and output conductive strips 14,14' is represented by an exponential curve shown in FIG. 2 by dotted lines. In FIG. 2, $Z_1$ is the input impedance, and $Z_2$ is the output impedance of the device. $Z_1$ and $Z_2$ are also the impedances of coaxial cables intended to be coupled to openings 10 and 9, respectively.

If the width of the rectangular film resistor is assumed to be L, the virtual boundary curve $y(x)$ is:

$$y(x) = C_1 exp(-2kx) + C_2 exp(2kx) \quad (1)$$

where:

$C_1$, $C_2$ are constants determined by the initial conditions, $k$ is a constant, $x$ is the length of the film resistor from the connection point with conductive strip 14. Substituting the initial conditions in equation 1, whereat $x = 0$, $y(x) = a_1$, and at $x = L$, $y(x) = a_2$, we obtain $$\left.\begin{aligned} C_1 &= \frac{[a_1 \exp(2kL) - a_2]}{\exp(2kL) - \exp(-2kL)} \\ C_2 &= \frac{[a_2 - a_1 \exp(-2kL)]}{\exp(2kL) - \exp(-2kL)} \end{aligned}\right\} \quad (2)$$

Substituting (2) in (1) and simplifying, $$y(x) = a_1 \frac{\text{Sinh } 2k(L - x)}{\text{Sinh } 2kL} + a_2 \frac{\text{Sinh } 2kx}{\text{Sinh } 2kL} \quad (3)$$

Figure 4:
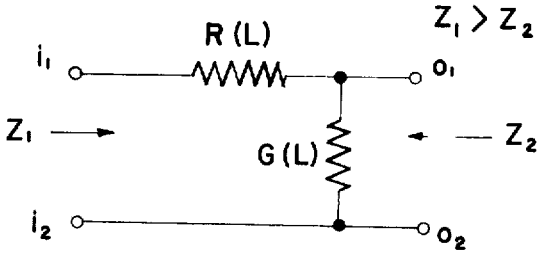
FIG. 4 is a schematic diagram of the device.

From the above, if the resistivity of the film resistor is assumed to be $\rho$ ohms per square, then the series resistance R(L) between the conductive strips 14 and 14' is:

$$R(L) = \rho \frac{2kL^2 \sinh 2kL}{(a_1 + a_2)(\cosh 2kL - 1)} \quad (4)$$

and if the length (x) of the film resistor is assumed to be D, then the parallel conductance G(L) between the conductive strips 14 and 14' and the conductive edge strips 12 and 12' is:

$$G(L) = \frac{4L^2}{\rho\left[DL - \frac{(a_1 + a_2)}{2k \sinh 2kL}(\cosh 2kL - 1)\right]} \quad (5)$$

and threfore, the equivalent circuit shown in FIG. 4 is obtained. From this:

$$Z_i = \sqrt{Z_1 Z_2} = \frac{\sqrt{R(L)}}{\sqrt{G(L)}} \quad (6)$$

and in (5), letting $$\gamma = \cosh 2kL = a_2/a_1$$

then the amount of attenuation $\alpha$ between the terminals $i_1 i_2$ and $o_1, o_2$ is:

$$\alpha = \text{arc} \sinh (2L) \frac{\cosh^{-1}\gamma}{a_1\sqrt{(\gamma^2 - 1)\frac{D \cosh^{-1}\gamma}{a_1\sqrt{\gamma^2 - 1}} - 1}} \quad (7)$$

$$Z_1 = \frac{\rho}{2}\sqrt{\frac{D \cosh^{-1}\gamma}{a_1\sqrt{\gamma^2 - 1}} - 1} \quad (8)$$

Therefore, the impedance matching device electonics with a desired amount of atenuation is formed with the film resistor patterns by selecting the widths $a_1$, $a_2$ of the input and output conductive strips 14,14', respectively, the length D, the width L, and the resistivity of the film resistor 13. For example, if an impedance matching device with $Z_1 = 75\Omega$, $Z_2 = 50\Omega$ is desired in the equivalent circuit of FIG. 4, then it is possible to achieve this by having the ratio of the widths of the input and output conductive strips 14,14' $a_1/a_2$ as 0.5, the length D, the width L, and the resistivity $\rho$ of the film resistor as 7mm, 0.97mm, 85.3 ohms per square respectively, thus also obtaining a desired 5.7dBm amount of attenuation.

FIG. 5 is a partial cross-sectional view showing an example of a coaxial impedance matching connector assembled utilizing the impedance matching device electronics (film resistor card 27) formed with the film resistor pattern arranged as mentioned above.

Figure 7:
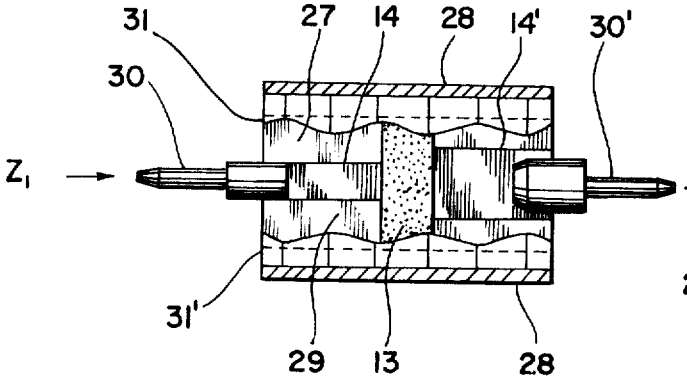
FIG. 7 is a cross-section taken along the line A—A in FIG. 6.
Figure 6:
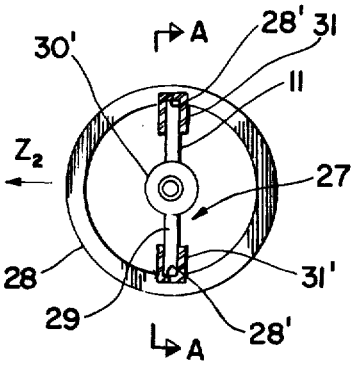
FIG. 6 is a lateral view of the film resistor card mounted in a housing according to the present invention.

FIGS. 6 and 7 are, respectively, a lateral view showing the structure of film resistor card 27 mounted in a sleeve 28, and a cross-sectional view taken along the line A–A' in FIG. 6.

FIG. 5 shows a first body 15, a center connector contact pin 16, a plug-in metal part 17 which engages center connector pin 16 and connects the center connector pin 16 with a male contact pin 30 coupled to the center conductive strip 14 of the impedance matching device 27, which will be described later in connection with FIGS. 6 and 7. Also shown in FIG. 5 is outer contact 18, connective coupling 19, connective opening 20, a second body 21, a second center connector pin 22, a second plug-in connective metal part 23 which engages center connector pin 22 and connects the center connector pin 22 with a male contact pin 30' coupled to the center conductive strip 14'. Also shown is the connective opening 24, the edge ring 25 of the first body 15 housing the impedance matching device electronics, and the edge ring 26 of the second body 21 housing and the impedance matching device electronics. The first and the second bodies are joined by screwing the edge rings 25 and 26 together. The impedance matching devices electronics in the form of film resistor card 27 is inserted, as shown in FIGS. 6 and 7, into an insertion sleeve 28. Alternatively, the card 27 may be inserted directly into a connector housing.

FIGS. 6 and 7 show the optional cylindrical insertion sleeve 28 adapted to hold a film resistor card 27 formed with the film resistor pattern 13. Male contact pins 30,30' are shown soldered (for example) to center conductive strips 14,14', and contact springs 31,31' are provided having a cross-sectional U-shape and fitted over the conductive strips 12,12' which are hidden and not seen in the figure. The film resistor card 27 of FIGS. 6 and 7 is fitted into the groove 28' in the inner surface of the sleeve 28 under the biasing forces of springs 31,31'. Next, it is housed in the body in the following manner. First, the card 27 is inserted into the edge ring 25 of the first body 15, and the male contact pin 30 on the card 27 is inserted into the plug-in connective metal part 17 of the first body 15. Then the second body 21 is placed over the protruding part of the card 27 and the male contact pin 30' is inserted into the plug-in connective metal part 23 of the second body 21. After this, the edges 25 and 26 are screwed together, joining the first and the second bodies 15,21, while at the same time fixing both edges of the sleeve 28 against shoulders 25',26' inside the edges of rings 25,26. Pressure-type connective metal parts with springs (not shown) may be used as a means to contact the center conductive strips 14,14' and the contact pins 30,30' rather than to use solder, if desired.

As explained above, the present invention offers the advantages of producing the impedance matching device electronics with the desired amount of attenuation and with consistent electrical characteristics, easily and inexpensively, since the conventional impedance matching device disc and rod resistors are replaced by a film resistor attenuator card formed with a film resistor pattern. In addition, contact pins 30,30' and the center conductive strips 14,14' of the card 27 are easily assembled by first fixing the card 27, with only the male contact pin 30 in the center thereof, inside the cylindrical sleeve 28 in such a way that the sleeve contacts the conductive strip 12,12', and secondly fixing the cylindrical sleeve 28 within the body 15, thirdly inserting the male contact pin 30' onto the card 27, and fourth attaching body 21 into place.

The assembly process is simple, since unlike the conventional devices with rod and disc resistors, force does not operate on the film resistor card in the process of assembling parts (but rather on the sleeve holding the card), thus removing the possibility of causing defects due to damage of the resistors and lessening the tendency of the resistor elements to crack. In addition, it is quite easy to manufacture a wide-band device by the employment of a simple printed circuit which suffers little influence from stray capacitance and inductance, unlike the composite parts in the conventional devices.

Therefore, the invention makes it possible to obtain a both mechanically and electrically superior coaxial impedance matching device.

The embodiments of the invention in which an exclusive property or privilege is claimed are defined as follows:

1. An impedance matching device comprising:

a rectangular insulative substrate;

a first conductive strip carried along one edge of said substrate;

a second conductive strip insulated from said first conductive strip and carried along an edge of said substrate opposite said one edge;

a film resistor deposited on said substrate extending between said conductive strips;

an input third conductive strip on said substrate between and insulated from said first and second conductive strips and connected to said film resistor, said input third conductive strip having a predetermined dimension in the direction transverse to said first and second conductive strips; and an output fourth conductive strip on said substrate between and insulated from said first and second conductive strips and disposed on the side of said film resistor opposite said input third conductive strip and connected to said film resistor, said fourth output conductive strip having a predetermined dimension in a direction transverse to said first and second conductive strips that is different from the corresponding predetermined dimension of said input third conductive strip to define an exponential impedance curve in said film resistor between the connections thereto of said third and fourth conductive strips.

2. The impedance matching device set forth in claim 1, wherein said film resistor is rectangular in shape.

3. The impedance matching device set forth in claim 1 wherein said conductive strips are printed metal strips, and further comprising: U-shaped members for clamping onto the edges of said substrate and electrically contacting said first and second conductive strips; and a pair of electrical contacts each having a slot therein for receiving an edge of said substrate and electrically contacting respective ones of said third and fourth conductive strips.

4. The impedance matching device set forth in claim 3, in combination with a connector body for housing said device, said connector body having longitudinal grooves therein for slidingly receiving said U-shaped members, said body including spring elements in said grooves for biasing said U-shaped members into electrical contact with said body.

5. The impedance matching device set forth in claim 3 including a cylindrical sleeve having opposed internal longitudinal grooves receiving said U-shaped members in electrical engagement, said sleeve including spring elements in said grooves for biasing said U-shaped members into electrical contact with said sleeve.

6. The impedance matching device set forth in claim 5 in combination with a connector body for housing said sleeve containing said substrate, said housing comprising two connector parts and a coupling ring for joining said connector parts to effect a forced electrical connection between said sleeve and said two connector parts.

* * * * *